US008074722B2

(12) United States Patent
Murphy, Jr. et al.

(10) Patent No.: US 8,074,722 B2
(45) Date of Patent: Dec. 13, 2011

(54) METHOD FOR SECURING A DAMAGED WELLHEAD

(75) Inventors: John M. Murphy, Jr., Marrero, LA (US); Ronald C. Gilbert, Madisonville, LA (US); Sigifredo Alvarado, Marrero, LA (US)

(73) Assignee: Vetco Gray Inc., Houston, TX (US)

( * ) Notice: Subject to any disclaimer, the term of this patent is extended or adjusted under 35 U.S.C. 154(b) by 498 days.

(21) Appl. No.: 12/027,797

(22) Filed: Feb. 7, 2008

(65) Prior Publication Data

US 2009/0200039 A1 Aug. 13, 2009

(51) Int. Cl.
*E21B 33/03* (2006.01)
*E21B 33/04* (2006.01)

(52) U.S. Cl. ..... 166/379; 166/277; 166/85.1; 166/75.13

(58) Field of Classification Search ..... 166/379, 166/277, 85.1, 75.13, 97.1
See application file for complete search history.

(56) References Cited

U.S. PATENT DOCUMENTS 3,255,823 A * 6/1966 Barton ..... 166/85.1
4,552,213 A * 11/1985 Boyd et al. ..... 166/88.4
4,646,827 A * 3/1987 Cobb ..... 166/88.2
5,299,644 A * 4/1994 Eckert ..... 166/379
5,332,043 A * 7/1994 Ferguson ..... 166/379
5,918,675 A * 7/1999 Borak et al. ..... 166/349
7,069,987 B2 * 7/2006 Kwasniewski et al. ..... 166/85.3
7,445,046 B2 * 11/2008 Borak, Jr. ..... 166/313
2008/0185156 A1 * 8/2008 Rodgers et al. ..... 166/379

* cited by examiner

*Primary Examiner* — Shane Bomar
*Assistant Examiner* — Robert E Fuller
(74) *Attorney, Agent, or Firm* — Bracewell & Giuliani LLP

(57) ABSTRACT

A technique for securing a subsea well that has had some of its components damaged as a result of a storm or other catastrophic event. The techniques utilizes a casing head assembly that may secured to the casing of the damaged well by tightening a plurality of set screws to drive slips into the casing. The casing head assembly may also comprise a tubing hanger. Tubing head set screws may then be tightened to activate the tubing hanger to secure the production tubing to the casing head. The casing head assembly may also comprise a latch-lock connector that may be secured to the casing head by stabbing the latch-lock connector into the casing head and rotating the connector approximately one-quarter turn. A corrosion cap may then be secured to the latch-lock connector to cover the end of the production tubing.

7 Claims, 7 Drawing Sheets

METHOD FOR SECURING A DAMAGED WELLHEAD

BACKGROUND

The invention relates generally to a system and method of securing a wellhead connector to casing of a wellhead assembly that has been damaged by a storm or other similarly destructive event. In particular, the invention relates to a system and method of installing a wellhead connector to the casing of a well having casing and production tubing, which extends from the sea floor to a surface wellhead.

Surface wellheads are a common feature of oil production. A production tree is attached to the wellhead to control the flow of oil and/or gas produced by the well. The oil and/or gas from the well passes through production tubing to a production tree. The production tree, in turn, may be coupled to a platform that couples the oil and gas to a pipeline for transfer to a processing facility.

A violent storm, such as a hurricane, can damage wells located on land, as well as offshore. For example, a storm can damage an offshore platform, the production tubing, and/or the production tree of a well by pulling the production tubing from its platform. Furthermore, tidal forces from a storm can blow over a production tree, damaging both the production tree and the production tubing.

Previous efforts at securing wells damaged by storms have been time-consuming and ineffective. These efforts have included installing devices using numerous loose bolts. However, installing these loose bolts is time-consuming and the bolts may be lost or misplaced, adding to the installation time. This is even more problematic for subsea well heads.

Therefore, a more efficient technique is desired for securing a well damaged by a storm or any other catastrophic event. In particular, a technique is desired that would enable a well to be secured quickly and securely.

BRIEF DESCRIPTION

A technique is provided for securing a well damaged by a storm or similar catastrophic event. The techniques utilizes a casing head assembly that may secured to the casing of the damaged well by tightening a plurality of set screws to drive slips into the casing. Before installing the casing head assembly, the casing of the damaged well is prepared for receiving the casing head assembly. For example, any valves secured to the well may be removed and the casing and production tubing of the well may be cut so that the production tubing extends a relatively-short defined distance from the end of the casing. Some preparation of the casing head assembly may also be performed, such as cleaning and coating surfaces.

Once the casing, production tubing, and the casing head assembly are ready, a portion of the casing head assembly, a casing head, may be installed onto the casing. As the casing head is lowered into position on the casing, the control line of the downhole safety valve of the well is fed into an inner bore of the casing head and then out of the casing head via a control line port through the side of the casing head. Once the casing head is in position on the casing, the casing head set screws may be tightened to secure the casing head to the casing.

The casing head assembly may also comprise a tubing hanger. The tubing hanger may be installed in the casing head after the casing head is secured to the casing. Tubing head set screws may then be tightened to activate the tubing hanger to secure the production tubing to the casing head.

In addition, the casing head assembly may also comprise a latch-lock connector that may be secured to the casing head.

The latch-lock connector may be stabbed into the casing head and rotated approximately one-quarter turn. This locks the latch-lock connector to the casing head. A corrosion cap may then be secured to the latch-lock connector to cover the production tubing.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
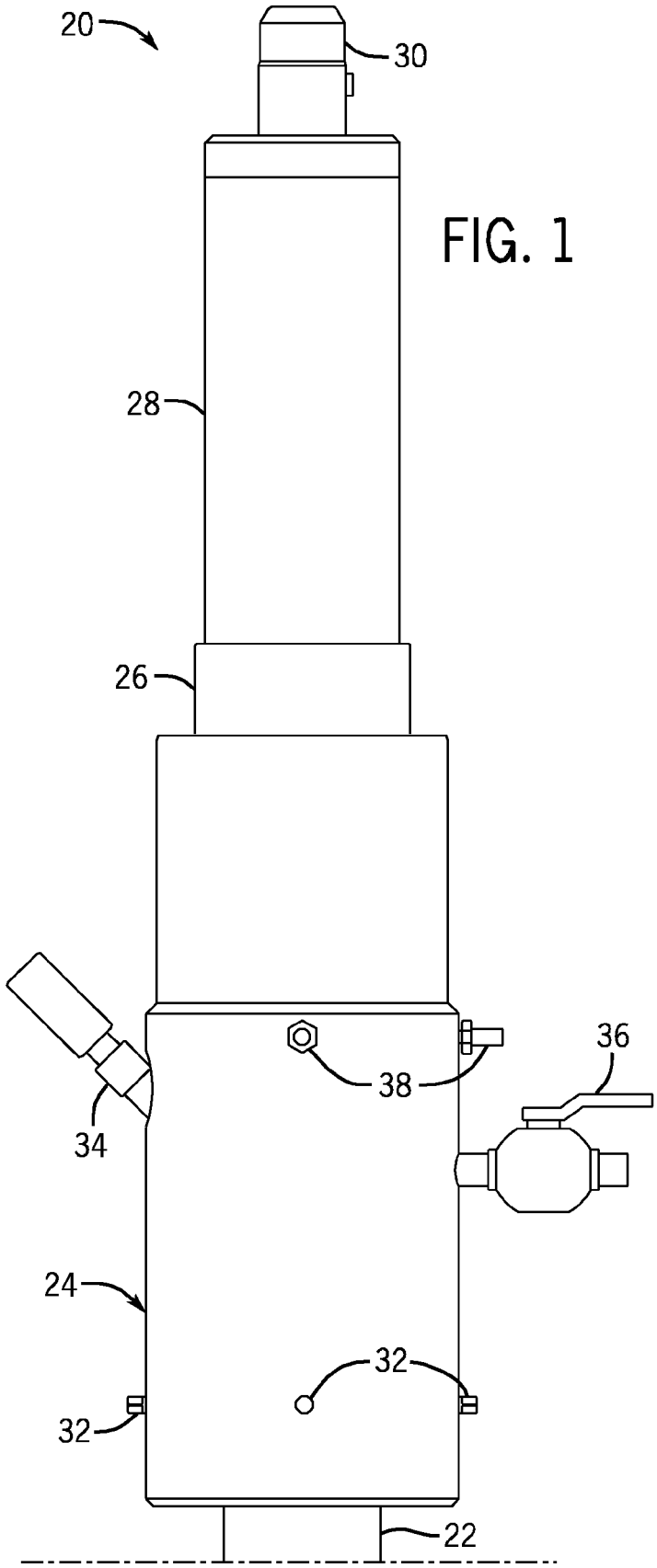
FIG. 1 is an elevation view of a casing head assembly secured by set screws to the casing of a damaged production assembly, in accordance with an exemplary embodiment of the present technique.

Referring now to FIG. 1, the present invention will be described as it might be applied in conjunction with an exemplary technique, in this case a casing head assembly for securing a damaged wellhead, as represented generally by reference numeral 20. The casing head assembly 20 is adapted to attach to the end of a string of casing 22 extending from a well bore. In a normal well in production, a production valve assembly would extend above a well head secured to the casing 22. In addition, production tubing would extend from the well within the casing and through the production valves to transport oil and/or gas to a surface platform, subsea manifold, or other location. In this embodiment, the casing head assembly 20 has been adapted to secure the innermost of several casing strings, as well as production tubing extending from the well to prevent any fluids therein from leaking into the surrounding waters. However, the casing head assembly 20 may be adapted to secure additional casing strings other than the innermost casing string of a well. For this, additional casing heads with larger diameters may be attached to the casing head assembly.

In the illustrated embodiment, the casing head assembly 20 comprises a casing head 24, a latch-lock connector 26, a corrosion cap 28, and a vent valve 30. The casing head 24 is adapted to attach to the casing 22 and secure the production tubing extending from the casing 22. The latch-lock connector 26 is adapted to connect to the casing head 24 to enable the corrosion cap 28 to be secured to the casing head 24. One end of the latch-lock connector 26 is adapted to secure to the casing head by being stabbed into the casing head 24 and then being turned one-quarter of a turn. The opposite end of the latch-lock connector 26 is adapted to receive and secure the corrosion cap 28. The corrosion cap 28 has one end that is adapted to be secured by the latch-lock connector 26. The opposite end of the corrosion cap 28 is configured with the vent valve 30 to enable any gasses that leak into the corrosion cap 28 to be vented. For example, the vent valve 30 may prevent an explosive concentration of gases from building up within the corrosion cap 28.

The casing head 24 has a series of casing head set screws, or dogs 32, spaced circumferentially around the lower end of the casing head 24. As will be discussed in more detail below, within the casing head 24 are slips that bite into the casing 22 when the casing head set screws 32 are tightened. These slips grip the casing 22 and secure the casing head 24 to the casing 22. In this embodiment, the casing head 24 has six casing head set screws 32. A family of casing heads may be established to correspond to various standard casing sizes. In addition, the outer diameters of the casing heads 24 are established to correspond to a larger standard casing size. Thus, if addition to the inner casing string, a larger casing string is desired to be secured, a smaller casing head may be inserted into a larger casing head in a wedding cake arrangement.

The casing head 24 also has a control line tie-in 34 that enables external access to a control line extending from the well within the casing 22. The control line tie-in and control line enable pressure to be applied to the well to set a downhole safety valve. The control line is fed to the control line tie-in 34 through a port through the casing head 24. The port is angled at an acute angle relative to an axial inner bore within the casing head to make it easier for the control line to be fed through the casing head 24. In addition, the illustrated embodiment of the casing head has a valve to enable fluid to be removed from within the casing through an annulus formed between the casing and the production tubing.

The casing head 24 also has a series of tubing hanger set screws, or dogs 38, that are spaced circumferentially around an upper portion of the casing head 24. The tubing hanger set screws 38 are oriented to activate a tubing hanger within the casing head 24. As will be discussed in more detail below, the tubing hanger is positioned so that the production tubing extends through the tubing hanger within the casing head When activated, the tubing hanger expands outward to engage the casing head 24 and inward to engage the production tubing. This secures the production tubing to the casing head 24. In the illustrated embodiment, the casing head 24 has six tubing hanger set screws 38.

Figure 2:
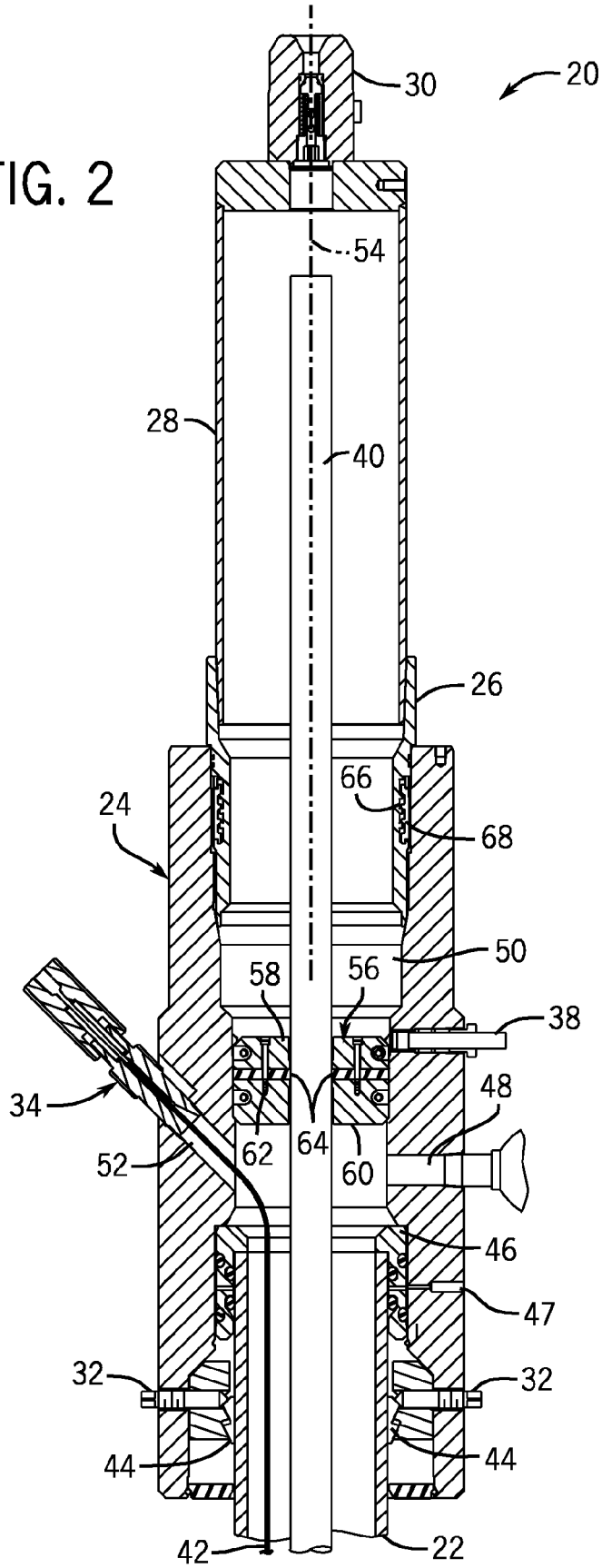
FIG. 2 is a cross-sectional view of the casing head assembly taken along the longitudinal axis of the casing head assembly of FIG. 1, in accordance with an exemplary embodiment of the present technique.

Referring generally to FIG. 2, a cross-sectional view of the casing head assembly 20 is presented. In addition, the production tubing 40 and control line 42 may be seen in this view. The casing 22 and production tubing 40 are cut in a wedding cake arrangement with the production tubing 40 extending a desired distance above the casing 22.

As noted above, slips 44 are used to secure the casing head 24 to the casing 22. As the casing head set screws 32 are tightened into the casing head 24, the casing head set screws 32 drive the slips 44 downward. This downward motion causes the slips 44 to bite into the casing 22, thereby gripping the casing 22 and securing the casing head 24 to the casing 22.

The casing head assembly 20 also utilizes a pack-off seal 46 that forms a seal between the casing head 24 and the casing 22. In this embodiment, the casing 22 is cut and prepared to facilitate the formation of a seal with the pack-off seal 46. The casing head 24 is adapted to receive the pack-off seal 46 and hold it in position so that the seal is made when the casing head 24 is lowered onto the casing 22. The casing head 24 also has a test port 47. Hydraulic pressure may be applied to casing head 24 through the test port 47 to verify that the casing head 24 is securely attached to the casing 22.

The casing head 24 has a valve port 48 that extends from an inner bore 50 of the casing head 24 to the exterior. In this embodiment, the valve port 48 is threaded to enable an annulus valve 36 to connect to the casing head 24. The valve port 48 enables the casing 22 to be drained through the casing head 24. The annulus valve 36 enables the drainage of the casing 22 to be controlled.

The casing head 24 also has a control line port 52 that extends through a side of the casing head 24 to the inner bore 50 of the casing head. The control line port 52 is oriented at an acute angle relative to a central axis 54 of the casing head assembly 20. For example, the control line port 52 may be angled at an angle of forty-five degrees or sixty degrees relative to the central axis 54. Insertion of the control line 42 through the control line port 52 is eased markedly by having the control line port 52 oriented at an acute angle, rather than a ninety degree angle. In the illustrated embodiment, the control line port 52 is oriented at an angle of sixty degrees.

A tubing hanger 56 is used to secure the production tubing 40 to the casing head 24. The tubing hanger 56 has two semi-circular half-pieces that are secured to each other by screws. The two half-pieces of the tubing hanger 56 may be separated to facilitate placing the tubing hanger 56 around the production tubing 40. Once located around the production tubing 40, the two pieces of the tubing hanger 56 may be joined. In addition, each of the two tubing hanger pieces has an upper portion 58 and a lower portion 60 held together by screws 62. The tubing hanger 56 also has a rubber packer 64.

The tubing hanger 56 sits in a landing in the casing head 24. The top of the upper portion 58 of the tubing hanger has a beveled surface. When the tubing hanger set screws 38 are tightened they drive against the beveled surface of the tubing hanger 56, which drives the upper portion 58 of the tubing hanger 56 downward toward the lower portion 60. This causes the rubber packing 64 to be expanded outward toward the casing head 24 and inward toward the production tubing 40. This secures the production tubing 40 to the casing head 24.

In the illustrated embodiment, the casing head 24 has a female threaded connector 66 and the latch-lock connector 26 has a corresponding male threaded connector 68. The female threaded connector 66 and the male threaded connector 68 form a high-strength connection. The connectors 66, 68 are adapted to be stabbed together and then rotated approximately one-quarter turn to make-up the connection. In this embodiment, a quadruple helix thread form is used by the connectors 66, 68. The threads interlock as they are rotated relative to each other.

In the illustrated embodiment, the vent valve 30 is located at the highest point of the corrosion cap 28 to prevent as little build-up of gas as possible within the corrosion cap 28. The vent valve 30 may utilize a check valve or some other type of pressure-relieving valve.

Figure 3:
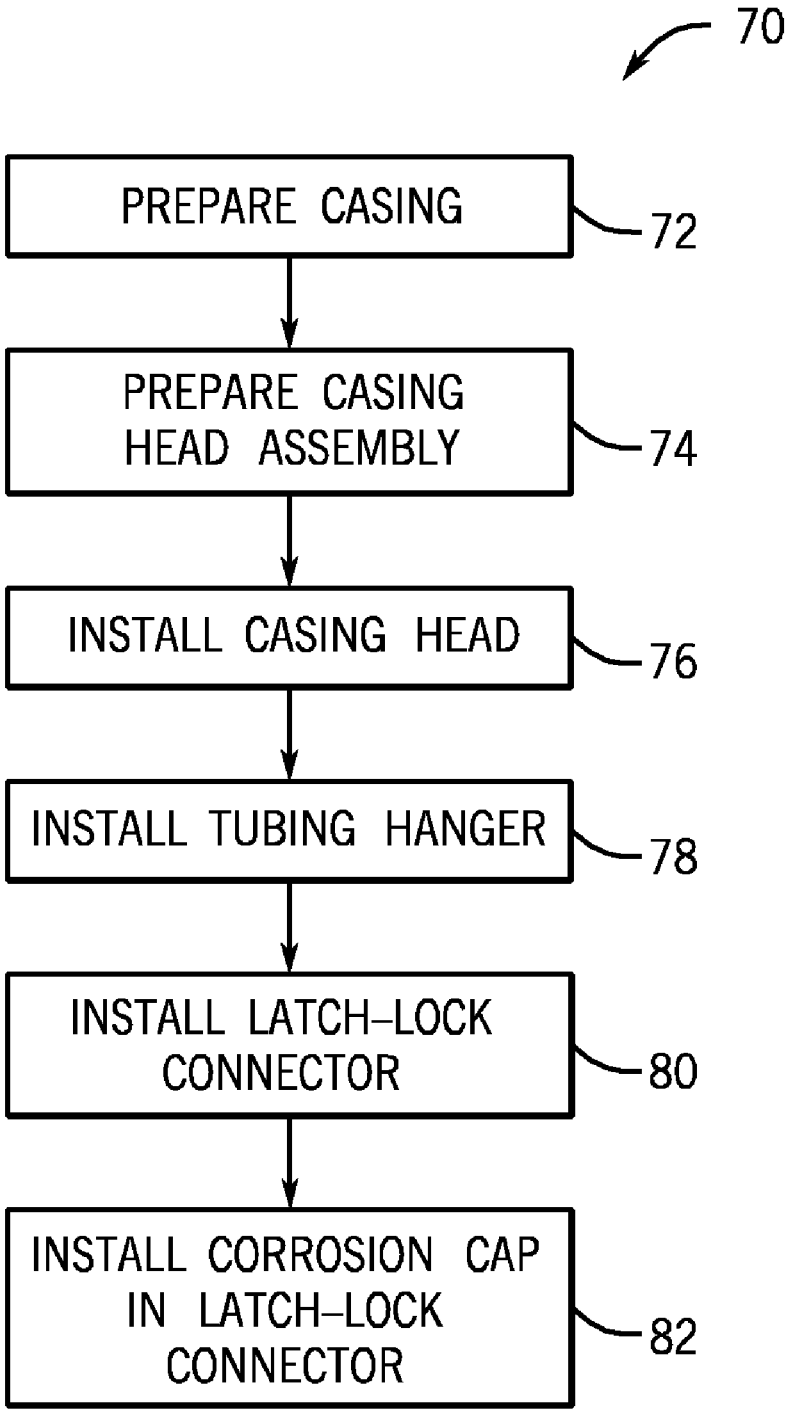
FIG. 3 is a block diagram of a method for securing a wellhead using a casing head assembly that is securable to casing using set screws, in accordance with an exemplary embodiment of the present technique.

Referring generally to FIG. 3, a method of securing a damaged well using the casing head assembly 20 is presented, and represented generally by reference numeral 70. Initially, the casing 22 is prepared for receiving the casing head assembly, represented generally by block 72. If the well has a "Christmas tree" or similar production valves, these must be cut from the end of the casing. Preferably, the end of the casing 22 is cut to provide a desirable surface for forming a seal. In addition, the outer diameter of the end of the casing 22 should be beveled. In addition, it is preferable that the casing is cut so that a straight portion of casing is presented to the casing head assembly 20. As noted above, the production tubing 40 and casing 22 are cut in a wedding cake arrangement with the production tubing 40 cut to extend a defined distance from the end of the casing 22. In addition, if there is more than one string of casing in the well, the inner casing is cut so that it extends from the other strings of casing to provide an adequate surface to receive the casing head 24. In addition, if it is desired to secure the ends of other strings of casing, they should also be cut in this wedding cake arrangement to enable these strings of casing to receive additional casing head sections.

Some preparation of the casing head assembly 20 may also be performed, as represented generally by block 74. For example, the casing head assembly 20 may be cleaned and a coat of light grease may be applied to all moving parts. Various dimension checks may also be preformed.

Once the casing 22, production tubing 40, and casing head assembly 20 are ready, the casing head 24 may be installed onto the casing 22, as represented generally by block 76. A lifting device may be used to lower the casing head 24 to the casing 22. The control line 42 is fed into the inner bore 50 of the casing head 24 and though the control line port 52 as the casing head 24 is lowered into position. Once the casing head 24 is in position on the casing, the casing head set screws 32 may be tightened. Preferably, the casing head set screws 32 are tightened in an alternating crisscross manner in increments until a desired torque is reached. In addition, the casing head 24 may be pulled to ensure that the casing head 24 is secured to the casing 22. For example, a 10,000 lbf pull may be applied to the casing head 24 to ensure that the casing head 24 is properly gripping the casing 22. The casing head set screws 32 may be re-tightened to the desired torque after the test pull.

In this embodiment of the method, the tubing hanger 56 is installed in the casing head 24 after the casing head 24 is secured to the casing 22, as represented generally by block 78. Initially, the two halves of the tubing hanger 56 are separated. The two half-pieces are then wrapped around the production tubing 40 and secured together with screws. The tubing hanger 56 is then lowered into the casing head toward a landing shoulder within the casing head 24. Preferably, the annulus valve 36 is open during this process. The tubing head set screws 38 are then tightened in an alternating crisscross manner in increments until a desired torque is reached.

In the illustrated embodiment, the latch-lock connector 26 is secured to the casing head 24 after the tubing hanger 56 is activated within the casing head 24, as represented generally by block 80. The latch-lock connector 26 is stabbed into the casing head 24 and rotated approximately one-quarter turn. This brings all of the threads of the connectors 66, 68 into engagement.

The corrosion cap 28 is then secured to the latch-lock connector 26 over the production tubing 40, as represented generally by block 82. The production tubing 40 is thereby covered so that any leakage from inside the production tubing is contained within the corrosion cap 28. If the vent valve 30 is separate from the corrosion cap 28 it would now be installed. Thus, the casing 22 and production tubing 40 are secured and prevented from leaking into the surrounding waters. In addition, access to the control line 42 of the well is provided.

Figure 4:
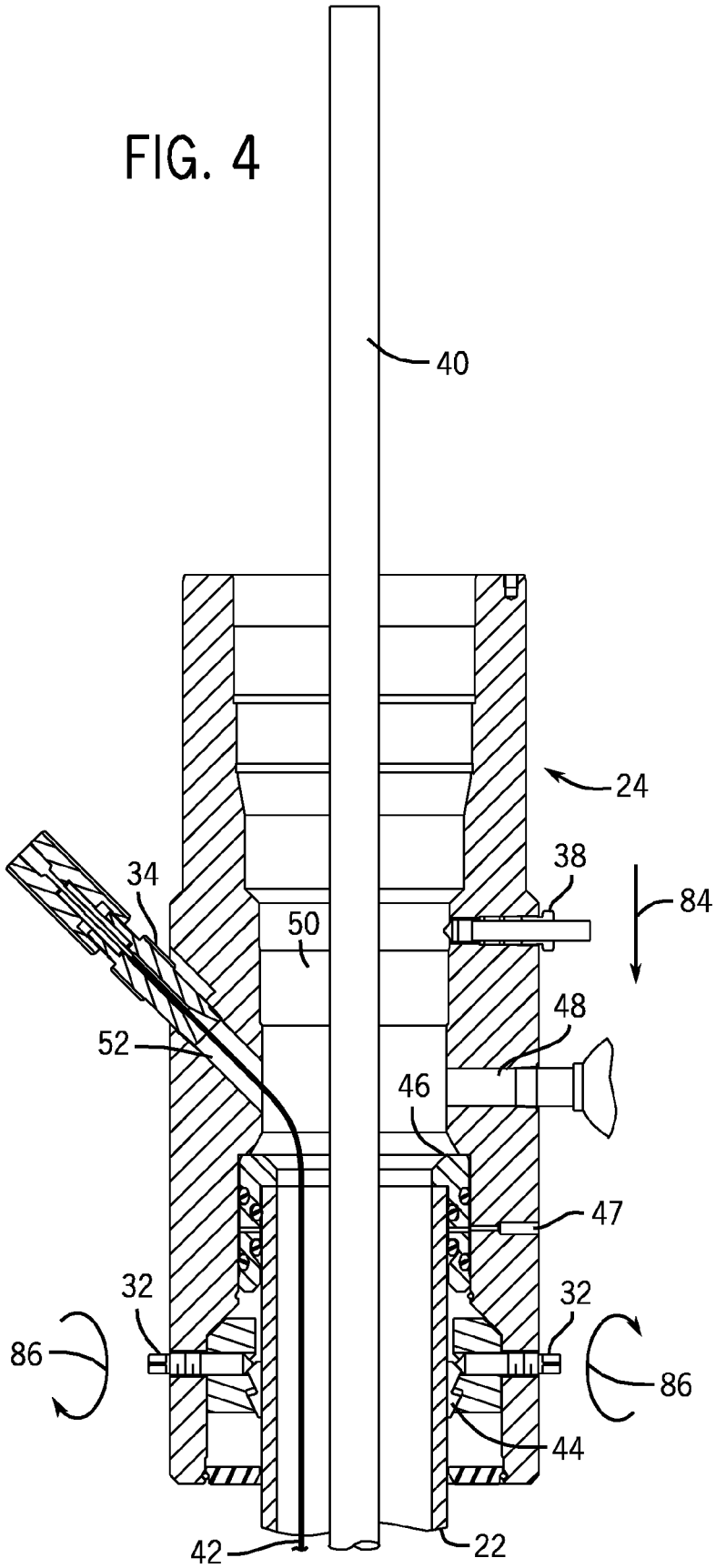
FIG. 4 is a cross-sectional view of the casing head secured to casing using set screws, in accordance with an exemplary embodiment of the present technique.

Referring generally to FIG. 4, the process of installing the casing head 24 to the casing 22 is presented. The casing head 24 is lowered into position on the casing 22, as represented by arrow 84. The pack-off seal 46 is seated on the end of the casing 22, forming a seal between the casing head 24 and the casing 22. Once in position, the casing head set screws 32 are tightened, as represented by arrows 86. Tightening the casing head set screws 32 causes the casing head set screws 32 to drive the slips 44 downward, biting into the casing 22. This biting action of the slips 44 grips the casing 22 to the casing head 24, securing the casing head 24 to the casing 22.

Figure 5:
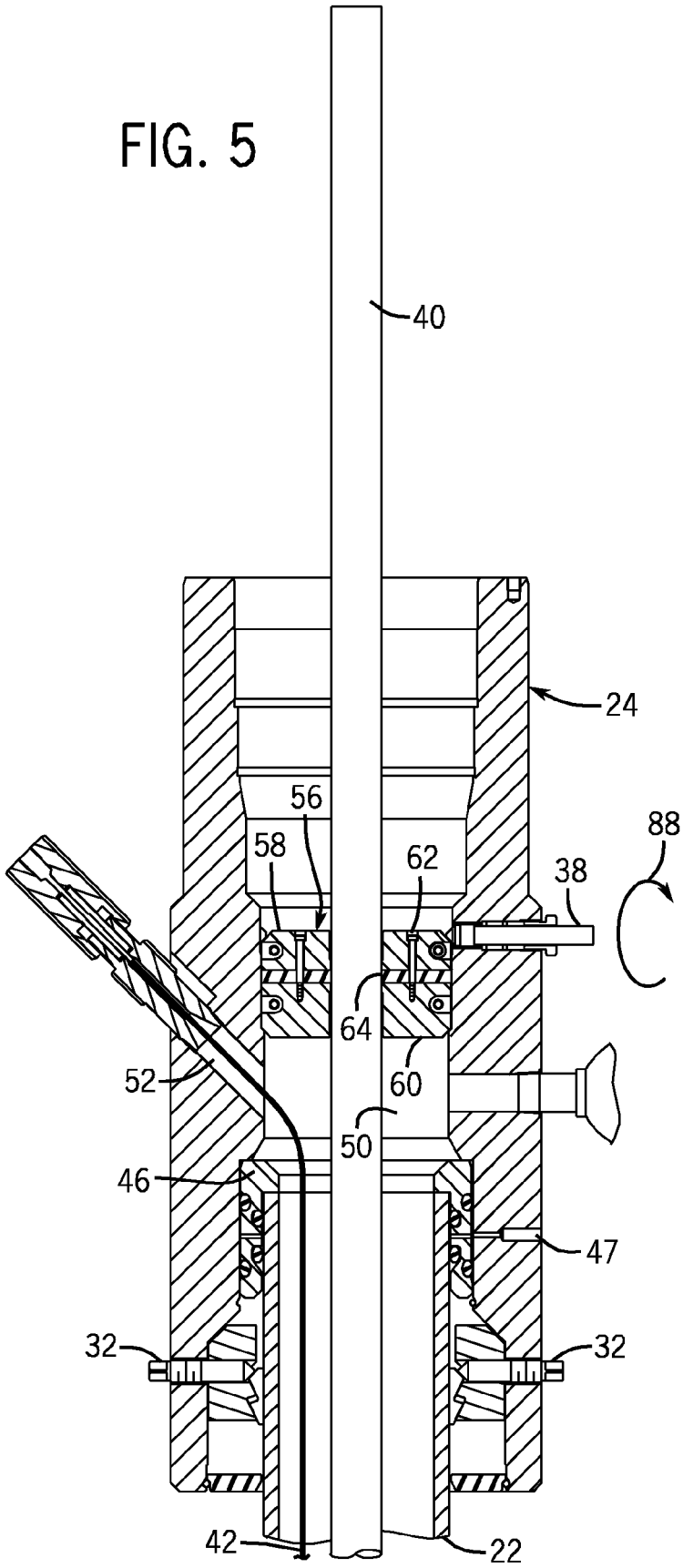
FIG. 5 is a cross-sectional view of a tubing hanger secured to the casing head using set screws, in accordance with an exemplary embodiment of the present technique.

Referring generally to FIG. 5, the process of installing the tubing hanger 56 within the casing head 24 is presented. As discussed above, in this embodiment, the tubing hanger 56 is composed of two half-pieces that are joined together around the production tubing 40. The tubing hanger set screws 38 are then tightened, as represented by arrow 88. This causes the upper portion 58 of the tubing hanger 56 to be driven downward toward the lower portion 60 of the tubing hanger 56.

Figure 6:
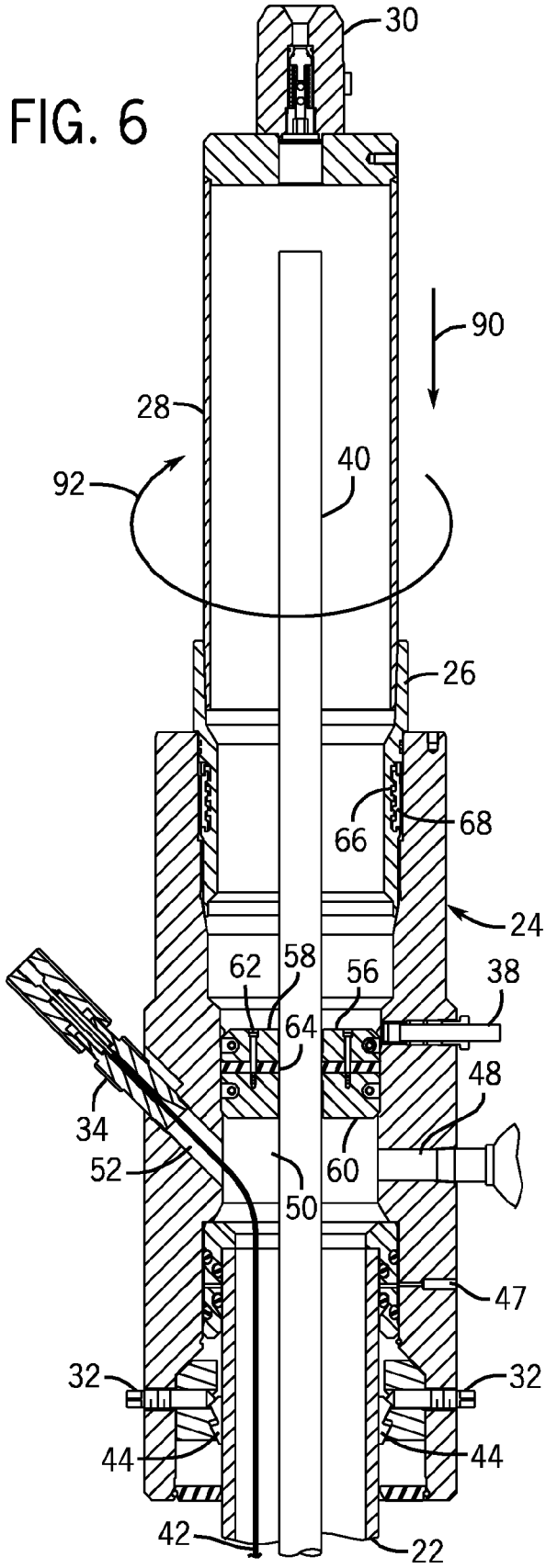
FIG. 6 is a cross-sectional view of a latch-lock connector and corrosion cap secured to the casing head, in accordance with an exemplary embodiment of the present technique.

Referring generally to FIG. 6, the process of securing the latch-lock connector 26 and the corrosion cap 28 to the casing head 24 is presented. The latch-lock connector 26 is stabbed into the casing head 24, as represented generally by arrow 90. The latch-lock connector 26 is then rotated clockwise approximately one-quarter turn, or ninety degrees, to secure the latch-lock connector 26 and the corrosion cap 28 to the casing head 24, as represented by arrow 92.

Figure 7:
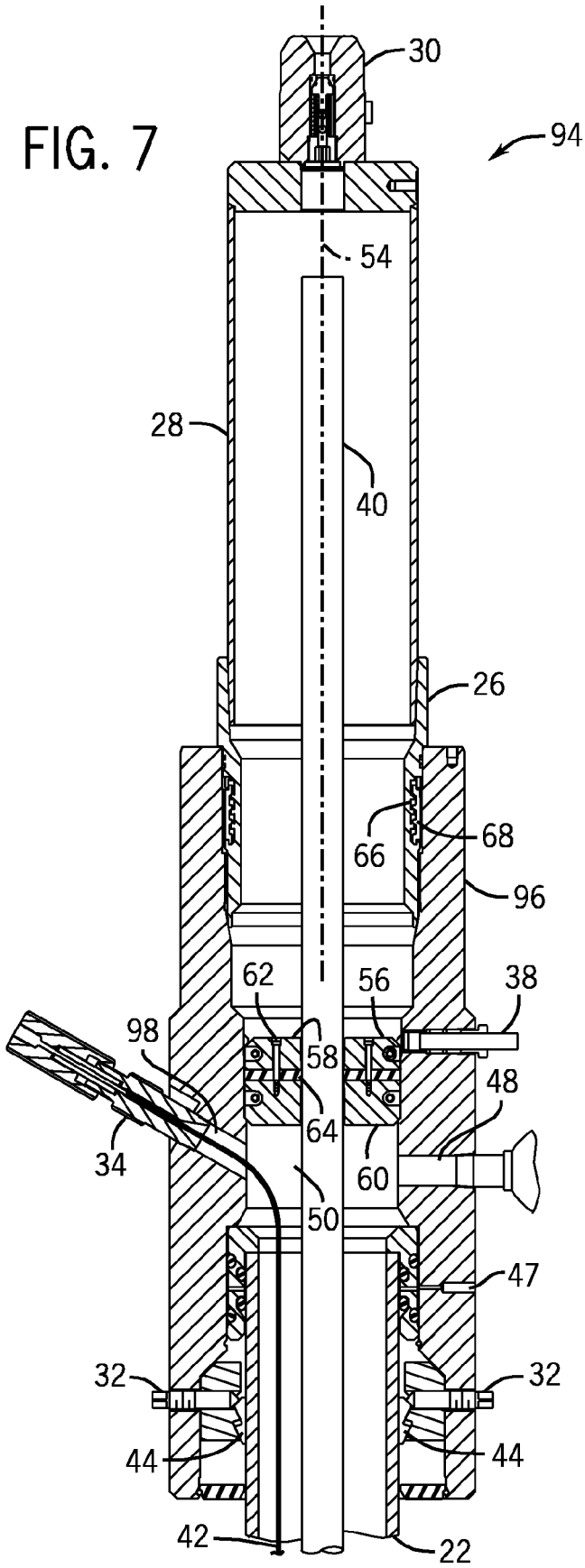
FIG. 7 is a cross-sectional view of a casing head adapted to receive a control line from the well at an angle of forty-five degrees, in accordance with an alternative exemplary embodiment of the present technique.

Referring generally to FIG. 7, an alternative embodiment of a casing head assembly is presented, and represented generally by reference numeral 94. In this embodiment, the casing head 96 has a control line port 98 that is angled at an angle of forty-five degrees relative to the central axis 54 of the casing head 24, rather than sixty degrees as in the previous embodiment.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method of securing a damaged well, comprising:

cutting a production tube extending upward from the well to a defined height above an end of casing extending from the well;

lowering a casing head over the end of casing extending upward from a well;

tightening a first set of set screws located circumferentially around the casing head to drive slips within the casing head into the casing to secure the casing head to the casing;

disposing a tubing hanger within the casing head;

tightening a second set of set screws located circumferentially around the casing head to activate the tubing hanger within the casing head; and securing a cap to the casing head to cover the cut end of the production tube extending up from the well through the casing string and the casing head.

2. The method of securing a damaged well as recited in claim 1, comprising:

disposing a seal within the casing head, wherein the seal forms a seal between the casing and the casing head when the casing head is lowered onto the casing.

3. The method of securing a damaged well as recited in claim 2, comprising:

cutting the casing to produce an end of the casing for receiving the casing head.

4. The method of securing a damaged well as recited in claim 1, comprising:

disposing a control line extending from the well within the casing through a port in the casing head that is oriented at an acute angle relative to a line passing upward from the well through an inner bore of the casing head.

5. The method of securing a damaged well as recited in claim 1, wherein securing the cap to the casing head comprises:

stabbing a connector into an upper end of the casing head; and rotating the connector approximately one-quarter turn to secure the connector to the casing head; and securing the cap to the connector to cover the upper end of the casing head.

6. The method of securing a damaged well as recited in claim 1, comprising:

disposing a valve into a port through the casing head to control access to the inner diameter of the casing.

7. The method of securing a damaged well as recited in claim 1, comprising:

disposing the slips within the casing head.

* * * * *